United States Patent [19]

Guy

[11] 3,936,129

[45] Feb. 3, 1976

[54] MOLDED PLASTIC HOOD ASSEMBLY FOR A CABLE CONNECTOR PLUG

[75] Inventor: Rodney J. Guy, Boulder, Colo.

[73] Assignee: Western Electric Company, Incorporated, New York, N.Y.

[22] Filed: Sept. 16, 1974

[21] Appl. No.: 506,646

[52] U.S. Cl. ..... 339/103 R; 174/138 F; 339/36; 339/75 M; 339/107

[51] Int. Cl.[2] ..... H01R 13/58

[58] Field of Search ..... 174/138 F; 339/103 C, 36, 339/49 R, 75 M, 99 R, 107

[56] References Cited

UNITED STATES PATENTS 3,803,530 4/1974 Lapraik ..... 339/36

*Primary Examiner*—Roy Lake
*Assistant Examiner*—DeWalden W. Jones
*Attorney, Agent, or Firm*—D. D. Bosben

[57] ABSTRACT

A protective hood for a cable connector plug is made of a one-piece molded plastic construction. At its forward end the hood includes a resilient tab which snaps into locked relationship with the plug as the hood is slidably assembled to the plug, and at its opposite end the hood can be securely connected to the cable, regardless of the cable diameter, by a self-locking cable tie. The cable is secured to the hood by flexing a pair of integral spaced guide elements projecting laterally from an upper rearward extension of the hood, to position an integral pressure pad beneath the cable jacket, whereafter the cable tie is inserted through an eyelet molded in a top portion of the hood extension. Utilizing the hood portion defining the eyelet as a stop for a head of the cable tie, the tie then is tightened between the guide elements to cause the pressure pad to grip the cable jacket against the upper rearward extension of the hood.

9 Claims, 5 Drawing Figures

MOLDED PLASTIC HOOD ASSEMBLY FOR A CABLE CONNECTOR PLUG

BACKGROUND OF THE INVENTION

1. Field of the Invention

This invention relates to a molded plastic hood for a cable connector plug, and more specifically to a molded plastic hood which is economical, rugged and easy to assemble securely to a cable connector plug and an associated cable regardless of the diameter of the cable.

2. Description of the Prior Art

In the manufacture of certain jacketed electrical cables, such as for use in PBX and telephone switching apparatus, it is standard practice to secure cable conductors to the terminals of a connector plug and to provide the plug and the adjacent portion of the cable with a protective hood. For example, a commonly used hood of metal construction is secured at its forward end to the plug by a suitable metal screw and a pair of spaced integral hook portions which define slots for slidably receiving housing portions of the connector plug. Adjacent its rearward end the hood is secured to the connector plug by a pair of eyelets in its side walls which slidably receive projecting ears on the plug. The hood also includes a rearwardly projecting portion for overlying the jacket of the cable and having downwardly extending spaced clamping lugs for straddling the jacket. The cable is secured to the hood by another metal screw which is inserted through apertures in these lugs adjacent their lower ends and tightened to clamp the lugs about the cable jacket. When the jacket is of a relatively small diameter, since the positions of the lugs and the locations of the screw apertures therein are fixed, it is necessary to provide one or more inserts or spacers between the cable jacket and the clamping screw in order to secure the cable to the hood.

The protective hood also may be of plastic construction, this being advantageous over a metal hood from the standpoint of eliminating shorting of adjacent wired equipment by the hood, and/or the shorting of the terminals of the plug and/or the cable conductors by the hood. For example, the U.S. Pat. No. 3,803,530, issued Apr. 9, 1974 to S. J. Lapraik, discloses a plastic hood of telescoping construction. As in the case of the abovementioned metal hood, however, this plastic hood is secured to a cable connector plug by a pair of screws at its forward and rearward ends. A rearward section of the hood also includes an upper rearward extension which is secured to a cable by a self-locking cable tie. In the alternative, the cable tie may be replaced with a special housing which carries a lower clamp engageable against the underside of the cable jacket by the tightening of an associated third screw.

The J. Sugar U.S. Pat. No. 3,794,960, issued Feb. 26, 1974, also discloses the use of a self-locking cable tie in the securing of a cable to a two-part electrical connector shell of plastic construction, and the E. W. Forney, Jr. U.S. Pat. No. 3,200,364, issued Aug. 10, 1965, discloses a plastic protective cover for a cable connection which snaps into position on a base member and over a terminal assembly to which cable conductors are connected.

SUMMARY OF THE INVENTION

This invention relates to a plastic hood for a cable connector plug and an adjacent portion of a cable which is connected to the plug, wherein the cable is secured to the hood between an upper rearward extension of the hood and a lower pressure pad by a securing strap, such as a self-locking cable tie. Preferably, the hood is of one-piece plastic construction and the pressure pad is integrally connected to the upper rearward hood extension by a pair of spaced flexible guide elements. The cable is secured to the hood by flexing the guide elements to position the pressure pad beneath the cable jacket, whereafter the self-locking cable tie is inserted through an eyelet molded in a top portion of the hood extension. Utilizing the hood portion defining the eyelet as a stop for a head of the cable tie, the tie then is tightened about the hood extension and the pressure pad between the guide elements, with the guide elements further flexing to permit the cable to be gripped securely between the hood extension and the pressure pad regardless of the cable diameter. At its forward end, the hood also includes at least one retainer portion which defines a slot for slidably receiving a portion of the cable connector plug to preclude movement of the plug in a first direction, and a resilient retainer tab which snaps into an opening in the plug as the hood is slid into the plug, to preclude relative movement between the hood and the plug in a second direction perpendicular to the first direction.

DETAILED DESCRIPTION

Figure 1:
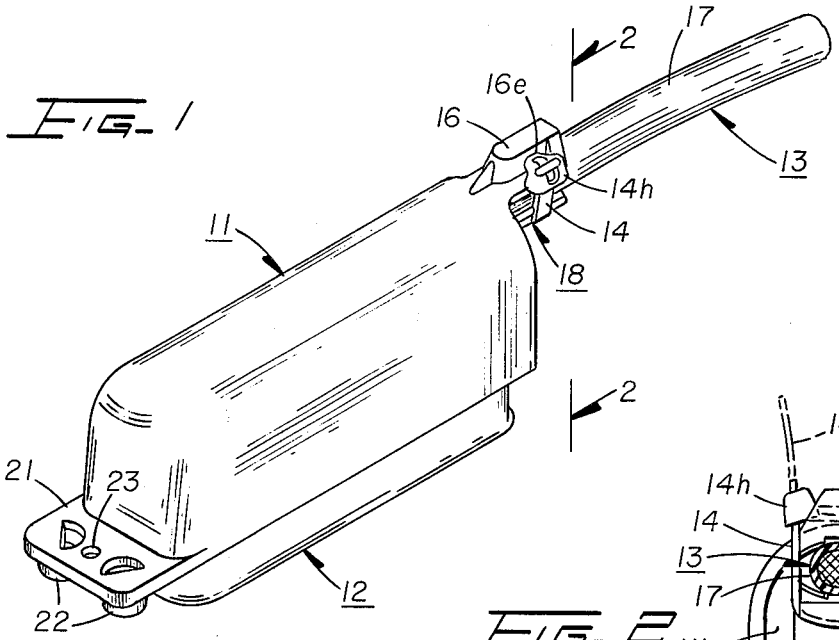
FIG. 1 is an isometric view of a protective hood in accordance with the invention, assembled to a cable connector plug and an associated cable.

Referring to FIG. 1, the disclosed embodiment of the invention relates to an elongated protective hood 11 of one-piece molded plastic construction for a likewise elongated cable connector plug 12 of a conventional type having conductors of a jacketed cable 13 secured to electrical terminals of the plug in a known manner. At its forward end of the hood 11 snaps into locked relationship with the plug 12 as the hood is slid onto the plug longitudinally thereof, and adjacent its rearward end the hood is secured to the cable 13 by a self-locking cable tie 14 of a conventional type. The hood 11 preferably is molded of a fire-resistant plastic having some degree of flexibility, such as that sold under the tradename "Noryl" (990) by the General Electric Company, Selkirk, New York.

Figure 2:
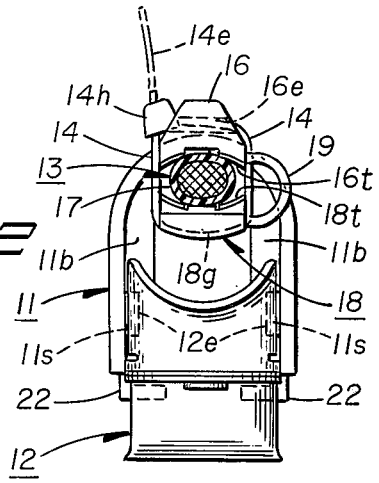
FIG. 2 is an end view of the hood in its assembled condition, looking in the direction of the arrows of 2—2 in FIG. 1.
Figure 3:
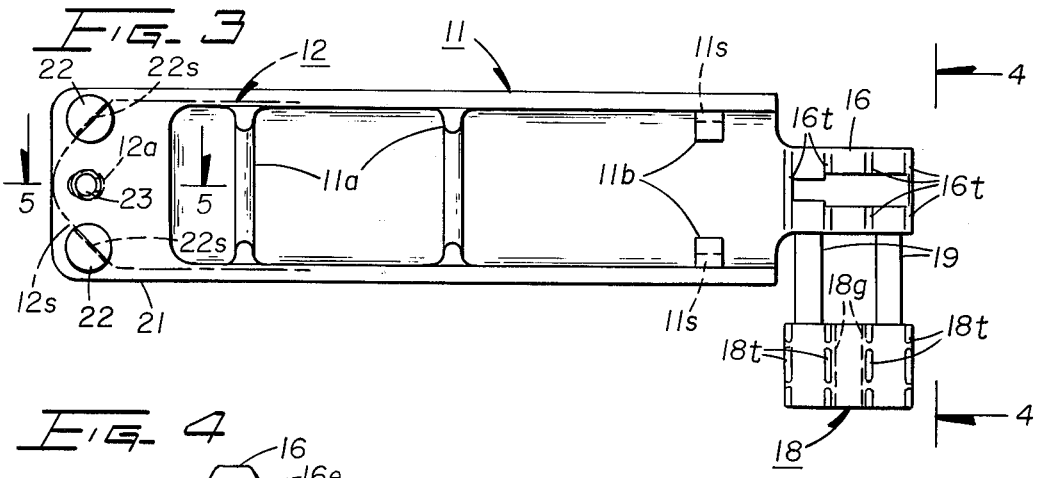
FIG. 3 is a bottom view of the protective hood in an unassembled condition.
Figure 4:
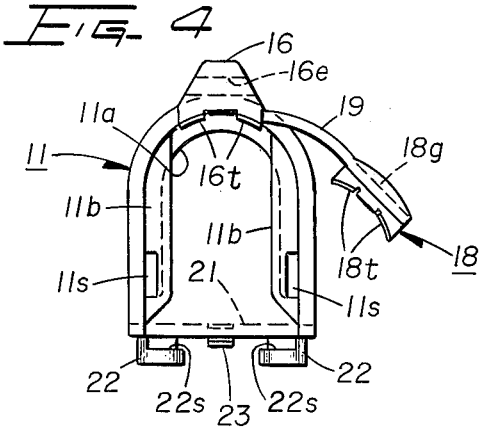
FIG. 4 is an upright end view of the unassembled hood looking in the direction of the arrows 4—4 in FIG. 3.

More specifically, the molded plastic hood 11 is in the form of a main body having an upper rearward rigid extension 16 for overlying upper surface portions of a jacket 17 of the cable 13, and includes an arcuate rigid pressure pad 18 for engaging beneath the cable jacket on its opposite or underside. As is best shown in FIGS. 2, 3 and 4, the pressure pad 18 is molded integrally with, but in spaced relationship to the upper rearward hood extension 16, being connected thereto by a pair of molded tongue or guide elements 19. The guide elements 19, which are spaced apart and which project laterally from the hood extension, are dimensioned in length and cross-section so as to be flexible in nature, to permit positioning of the pressure pad 18 beneath the cable jacket 17. Suitable retaining ridges or teeth 16*t* and 18*t* also are provided on inner surfaces of the hood extension 16 and the pressure pad 18 for gripping the cable jacket 17 and precluding relative movement between the plastic hood 11 and the jacket.

Adjacent its opposite or forward end the plastic hood 11 includes a forwardly projecting rigid planar portion 21 having a pair of spaced downwardly projecting plug retainer buttons 22, each of which has a slot 22*s* formed therein adjacent a bottom surface of the forwardly projecting planar portion for receiving a planar section 12*s* (illustrated in broken lines in FIGS. 3 and 5) of the connector plug 12 in sliding relationship. The slotted retainer buttons 22 and the forwardly projecting planar portion 21 of the hood 11 thus cooperate to preclude relative movement of the assembled hood and connector plug 12 in a first direction perpendicular to their longitudinal axes.

Figure 5:
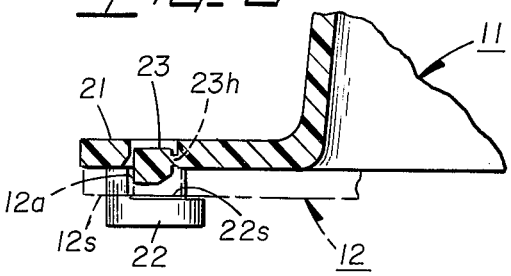
FIG. 5 is an upright detailed view of a forward end portion of the hood, taken along the line 5—5 of FIG. 3.

As is best shown in FIG. 5, a retainer tab 23 is integrally molded with the forwardly projecting planar hood portion 21 by a resilient hinge portion 23*h*, with a portion of the tab normally projecting downward below the bottom surface of the planar hood portion and being disposed in the plane of the slots 22*s* in the plug retainer buttons 22. Thus, as the planar section 12*s* of the connector plug 12 is slid into the slots 22*s* of the retainer buttons 22, the planar section initially deflects the resilient tab 23 upward, and as the planar section seats in the slots the tab snaps into an aperture or opening 12*a* in the planar section and into tight bearing engagement with a front wall of the opening. The plug retainer buttons 22 and the resilient tab 23 then cooperate to secure the hood 11 against relative movement with respect to the connector plug 12 parallel to their longitudinal axes (and thus against movement in a second direction perpendicular to the above-mentioned first direction).

As is best shown in FIG. 3, the internal surface of the plastic hood 11 is provided with a pair of arcuate reinforcing ribs 11*a* intermediate its ends. Adjacent the rearward end of the hood, the opposed side walls of the hood also are provided with a pair of opposed reinforcing ribs 11*b*, with each of these ribs including a molded slot 11*s* therein for receiving projecting ears 12*e* of the cable connector plug in sliding relationship as the hood and the plug are assembled together.

To secure the jacketed cable 13 to the plastic hood 11, the spaced guide elements 19 are flexed to position the rigid arcuate pressure pad 18 beneath the cable jacket 17 and the self-locking cable tie 14 is inserted through an eyelet 16*e* molded in a top portion of the rigid upper hood extension 16 in alignment with the space between the guide elements. Utilizing the portion of the hood extension 16 defining the eyelet 16*e* as a stop for a head 14*h* of the cable tie 14, the cable tie then is positioned between the guide elements 19, is engaged in an aligning and retaining groove 18*g* in the outer surface of the pressure pad 18, and then passed through the head of the cable tie. The cable tie 14 then is tightened around the upper hood extension 16 and the pressure pad 18, with the guide elements 19 further flexing as illustrated in FIG. 2, to permit the cable tie to grip the cable jacket 17 tightly between the upper hood extension and the pressure pad, after which an extraneous portion 14*e* (shown in dashed lines in FIG. 2) of the cable tie projecting beyond its head 14*h* is cut off in a conventional manner.

In summary, a protective plastic hood 11 for a cable connector plug 12 and an associated cable 13 has been provided which is economical, rugged and easy to assemble securely to the plug and the cable, regardless of the diameter of the cable. The molding of the plastic hood 11 and the rigid pressure pad 18 in one piece by means of the spaced flexible guide elements 19 is advantageous since this enables the hood and the pad to be molded in a single operation, with the pad anchored directly to the hood to insure that the pad always is readily available for use. Being flexible, the guide elements 19 also permit proper positioning of the rigid pressure pad 18 beneath the cable jacket 17 and subsequently permit tightening of the cable tie 14 to anchor the cable jacket securely between the rigid upper hood extension 16 and the pressure pad, regardless of the diameter of the cable 13. The guide elements 19 also cooperate with the eyelet 16*e* in the top portion of the hood extension 16 and the aligning groove 18*g* in the pressure pad 18 to hold and guide the cable tie 14 into proper position during the tightening thereof, and provide a degree of rigidity between opposite ends of the pressure pad and the hood extension to reduce the possibility of shifting or twisting of the pressure pad as the cable 13 is flexed during use. In addition, the top portion of the hood extension 16 defining the eyelet 16*e* provides a stop for the head 14*h* of the cable tie 14 to facilitate the tightening of the cable tie in the securing of the plastic hood 11 to the cable 13.

The resilient retainer tab 23 molded integrally with the plastic hood 11 at its forward end also is advantageous since it automatically snaps into the aperture 12*a* in the planar section 12*s* of the plug 12 to lock the hood securely to the plug as the hood and the plug are slid into assembled relationship, thus eliminating the need for, and the tightening of a separate securing screw, as in prior known protective hood arrangements. The resilient tab 23 also can later be depressed out of the aperture 12*a* for ready disassembly of the hood 11 and the plug 12.

What is claimed is:

1. A molded plastic hood and connector plug assembly, which comprises:

a hood body having an extension adjacent one end thereof;

a flexible tongue integrally connected to said extension on said body and projecting laterally therefrom;

a pressure pad integrally connected to said flexible tongue element in spaced relationship to said extension on said body;

molded rigid retainer means adjacent an opposite end of said body engaged with a portion of the connector plug to preclude relative movement between the hood and the plug in a first direction; and molded resilient retainer means adjacent the opposite end of said body engaged with a portion of the connector plug to preclude relative movement between the hood and the plug in a second direction perpendicular to the first direction.

2. A molded plastic hood and connector plug assembly, as recited in claim 1, in which:

said molded rigid retainer means includes a slot slidably receiving a portion of the connector plug; and said molded resilient retainer means includes a molded resilient tab integrally connected to said body, said tab being disposed in the plane of the slot of said rigid retainer means and received in an opening in a portion of the connector plug to secure the hood to the connector plug.

3. A molded plastic hood and connector plug assembly, as recited in claim 1, which further comprises:

a second flexible tongue element spaced from said first flexible tongue element and integrally connected at opposite ends to said body extension and said pressure pad, respectively.

4. A molded plastic hood and connector plug assembly, as recited in claim 1, in which:

said body extension has a strap-receiving eyelet formed in a portion thereof.

5. A protective assembly including a cable connector plug, which comprises:

a molded plastic hood having portions of the connector plug and of a cable connected to the plug received therein, said hood including an extension adjacent one end thereof engaging surface portions on one side of the cable;

a pressure pad engaging surface portions on an opposite side of the cable;

a securing strap encircling the cable and gripping the cable between said pressure pad and said extension of said hood;

rigid retainer means adjacent an opposite end of said molded plastic hood engaged with a portion of the connector plug to preclude relative movement between said hood and the plug in a first direction; and resilient retainer means adjacent the opposite end of said plastic hood engaged with a portion of the connector plug to preclude relative movement between said hood and the plug in a second direction perpendicular to the first direction.

6. A protective assembly including a cable connector plug, as recited in claim 5, in which:

said rigid and resilient retainer means are integrally molded plastic portions of said plastic hood;

said molded rigid retainer means includes a slot having a portion of the cable connector plug slidably received therein; and said molded resilient retainer means includes a molded resilient tab received in an opening in a portion of the cable connector plug.

7. A protective assembly including a cable connector plug, as recited in claim 5, in which:

said pressure pad is of molded plastic and is integrally secured to said extension of said plastic hood by a pair of laterally spaced molded plastic guide elements; and said securing strap is disposed between said guide elements.

8. A protective assembly including a cable connector plug, as recited in claim 5, in which:

said securing strap extends through a molded eyelet in a portion of said extension of said plastic hood.

9. A protective assembly including a cable connector plug, as recited in claim 8, in which:

said securing strap is a self-locking cable tie having a head engaged with a portion of said plastic hood which defines the eyelet therein.

* * * * *